US005501623A

United States Patent [19]

Bowen, III

[11] Patent Number: 5,501,623

[45] Date of Patent: Mar. 26, 1996

[54] PROPELLER DRIVE

[76] Inventor: Perry G. Bowen, III, 250 Adelina Rd., Prince Frederick, Md. 20678

[21] Appl. No.: 323,089

[22] Filed: Oct. 14, 1994

[51] Int. Cl.[6] ..... B63H 5/10

[52] U.S. Cl. ..... 440/75; 440/80

[58] Field of Search ..... 440/75, 79, 80, 440/81; 416/124, 127, 128, 129, 170 R; 74/480 B

[56] References Cited

U.S. PATENT DOCUMENTS

| | | | |
|---|---|---|---|
| 917,206 | 4/1909 | Watts | 440/81 |
| 4,642,059 | 2/1987 | Nohara | 440/81 |
| 4,828,518 | 5/1989 | Kouda et al. | 440/81 |
| 4,909,767 | 3/1990 | Hayasaka | 440/75 |

FOREIGN PATENT DOCUMENTS

| | | | |
|---|---|---|---|
| 212292 | 8/1990 | Japan | 440/81 |

*Primary Examiner*—Stephen Avila

[57] ABSTRACT

A propeller drive having coaxially aligned propellers separately operable or operable in unison in the same rotary direction. Independent operation of each propeller or operation of both in unison for maximum speed provides an efficient propeller drive for a marine vessel.

22 Claims, 4 Drawing Sheets

PROPELLER DRIVE

BACKGROUND OF THE INVENTION

Marine propulsion systems today consist of an engine, a forward/reverse transmission, possibly a reduction gear assembly and a propeller assembly. Variation in the speed of the vessel is brought about by changing the engine speed. The range of speed of the vessel is directly related to and limited by the range of speed of the engine.

There are advantages and disadvantages to the use of gasoline and diesel engines to propel boats. When compared against each other, diesel engines are more dependable, are more efficient, use fuel that is less dangerous, as well as less expensive, have a longer life, and require fewer parts and maintenance. Their only disadvantage is that they are not capable of sufficiently high speed to drive boats as fast as gasoline engines of comparable power, with current propeller drive systems.

The range of engine speed of gasoline engines which gives them the ability to propel boats faster than diesel engines is their single advantage. This is often the consideration which overrides all others in the selection of engines.

Gasoline engines have been the best choice for marine applications when a broad range of vessel speed is desired. This is simply because gasoline engines offer an engine speed range of 2 to 2.5 times that of a diesel engine. In addition, the cruising engine speed of the diesel engine is a much greater percentage of its overall engine speed with current drive configurations than the gasoline counterpart and therefore the fuel economy advantage is not as great.

Most marine propulsion systems have single propeller drives or dual propeller drives. The propeller is turned by the engine to move the water stream one way while the vessel is pushed in the other. Propellers are made of several axially inclined planes that turn with the propshaft by force of the engine. Propellers are measured by diameter and pitch. The pitch is determined by the angle of the inclined planes and measured by the distance the propeller would travel in a semisolid material in one revolution. The larger and greater degree of angle perpendicular to the propshaft of the propeller blades, the greater the thrust delivered per revolution. As the propeller turns, the water is forced in the direction opposite that you desire to drive the vessel by the inclined planes. The displaced water leaves an area of low pressure ahead of the blades which helps to pull the propeller in the desired direction.

Variable pitch propellers, either mechanically or centrifugally operated, and variable speed transmissions are the two means now available to bring about changes in the speed of vessels without changes in the engine speed. Mechanically operated variable pitch propellers are devices which permit the operator to change the pitch of the blades of the propellers, thereby increasing or decreasing the speed of the vessel without changing the speed of the propeller. When such propellers are centrifugally operated, a substantial change of propeller speed is required to bring about a change in pitch.

Variable pitch propellers, mechanically operated, are too expensive to be practical. Variable pitch propellers, centrifugally operated, used with gasoline engines, will not work with diesel engines because diesel engines are not capable of the broad range of engine speed that they require to actuate the apparatus which changes their pitch. Propellers driven by variable speed transmissions operated at high speeds tend to have any increased thrust offset by cavitation which rapidly damages the propeller.

Dual counter-rotating propeller systems are being used more and more today. They allow for improved slow speed performance because two propellers engage more water than does one. However, at high speeds the rearward propeller runs in the wash of the forward one and little or no speed range increase is obtained. In addition, the differential apparatus which provides for the counter rotation absorbs energy in its own right.

Coaxially aligned propellers for use with marine engines are well known in the art. Most propulsion systems having coaxially aligned propellers have one large driven propeller and one small free wheeling propeller. Such designs dating from 1906–1986 are shown and described in the U.S. Pat. Nos. to Gray 811,287, Cake 1,224,120, Kubota 3,549,271, and Grim 4,623,299.

Other types of boat propeller systems are disclosed in the U.S. Pat. Nos. to Dalen 888,390, Taylor 938,911, Pierce 1,910,561, DeMichelis 2,064,195, Naginskas 2,196,706, Pleuger 3,127,865, Nohara 4,642,059, Brandt 4,767,269, Kouda et al. 4,828,518, McCormick 4,832,636, and Japanese Patent 63-34295. These patents disclose propulsion systems which attempt to drive a marine vessel with greater efficiency. Varying levels of thrust are not addressed by any of the patents of the prior art. This invention is designed to place diesel engines in a position to drive a boat as fast or faster than a gasoline engine of comparable power, using diesel engines with the range of engine speeds being manufactured today, and allowing low speed operation without using a "trolling valve" or similar propeller shaft speed reduction device.

SUMMARY OF THE INVENTION

It is an object of the invention to provide a propeller drive having coaxially aligned propellers which rotate in the same direction independently or in unison.

It is also an object of the invention to provide a propeller drive having coaxially aligned propellers and a clutch assembly for engaging either propeller or both propellers.

Still another object of the present invention is to provide a propeller drive having a driven inner propeller and a driven outer propeller which may be locked in unison.

A further object of the present invention is to provide a propeller drive for an outboard or inboard/outboard motor.

The object of the invention is to provide a propeller drive whereby a boat can be driven at a maximum hull speed by an engine of sufficient power without regard to maximum engine speed and also be driven at slow hull speeds by the same engine. The present invention provides independent operation of each propeller or operation of both in unison for maximum speed. Each propeller is suitably structured in such a way that when locked together they function as if they were one propeller.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENTS

Figure 1:
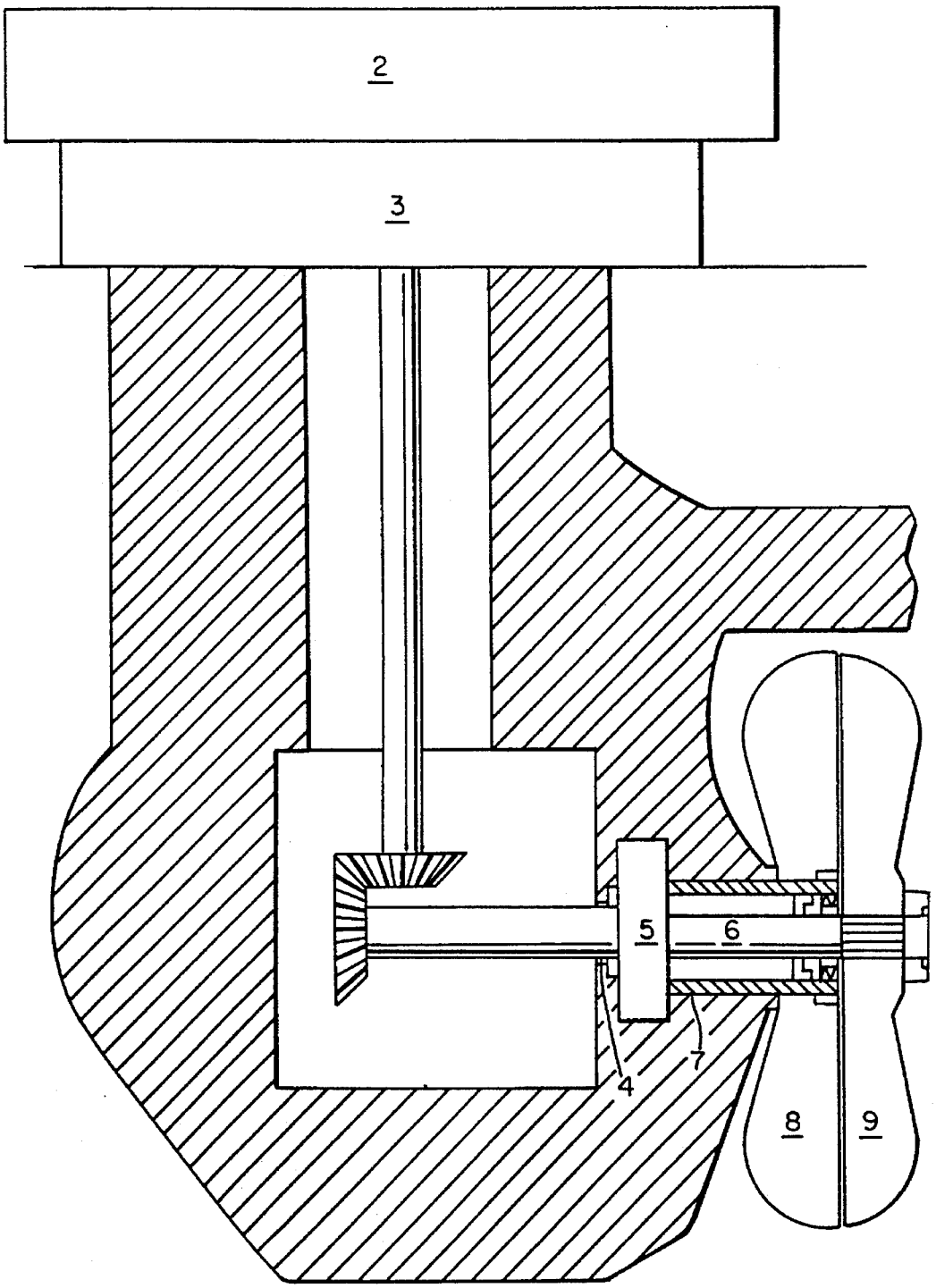
FIG. 1 is a sectional view of a propeller drive employed with an outboard motor.

FIG. 1 illustrates a sectional view of a propeller drive (1) of an outboard motor for a marine vessel. The propeller drive (1) is operated by an engine (2) which preferably is of the diesel type but may be any type of engine. The engine (2), a transmission (3), and an output shaft (4) are connected to the propeller drive through an arrangement well known in the art.

The propeller drive includes a clutch assembly (5), an inner propeller shaft (6), an outer propeller shaft (7), an inner propeller (8), and an outer propeller (9). The described arrangement is constructed to permit the operator of the marine vessel to operate each propeller independently or both propellers in unison for rotation in the same direction. The present invention will now be described in greater detail.

Figure 2:
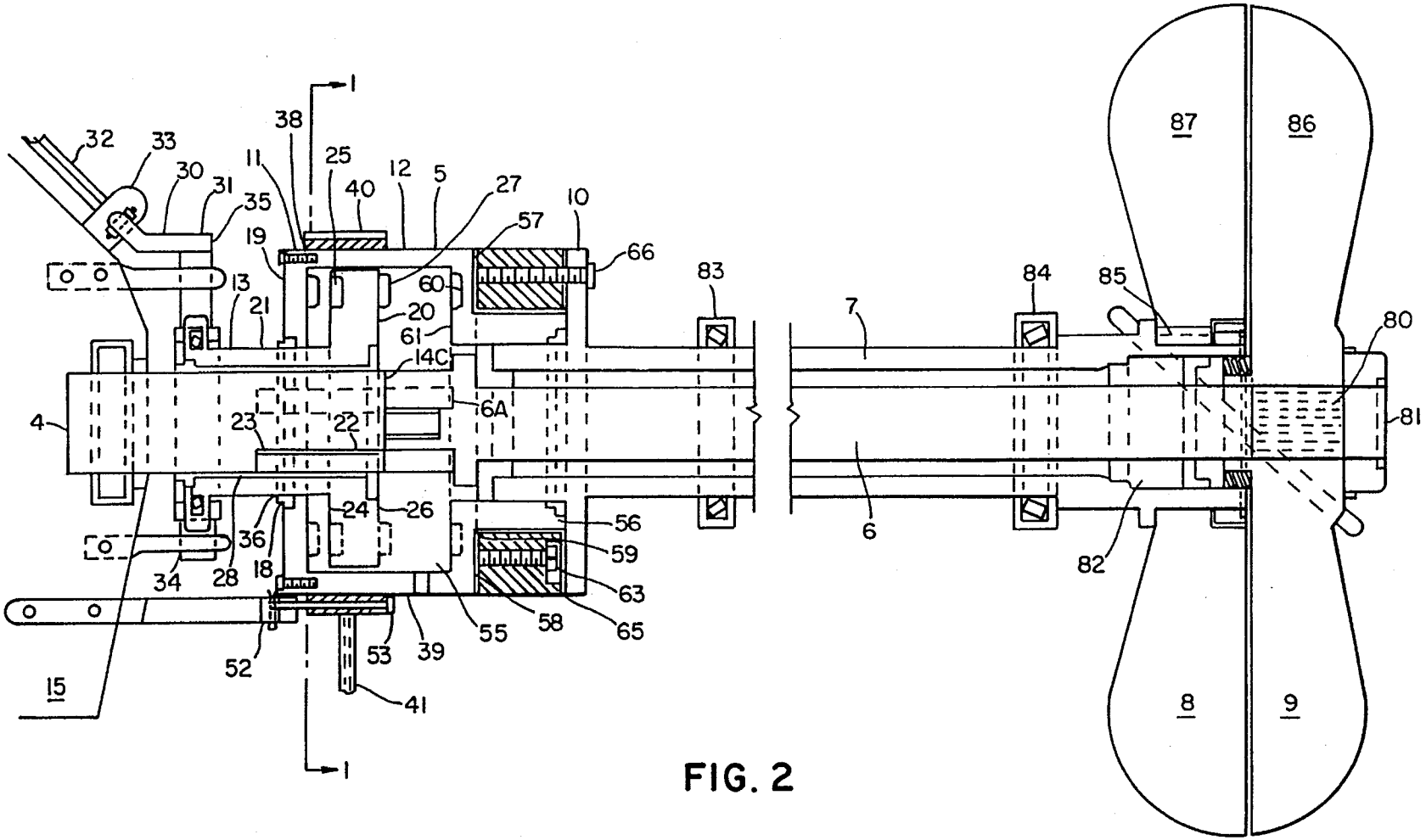
FIG. 2 is a schematic side elevational view of a propeller drive which incorporates the various aspects of the invention.

With reference to FIG. 2 the propeller drive having a forward propeller shaft mounting according to a first embodiment of this invention will now be described in detail. FIG. 2 is an enlarged sectional view of the forward propeller shaft mounting of the propeller drive.

The propeller drive has a pair of coaxially mounted propellers (8, 9) disposed for rotation generally aft of clutch assembly (5). The clutch assembly (5) generally includes a clutch housing (10) and a clutch means (11) for engaging either propeller or both. The clutch housing is connected to an engine/transmission output shaft (4) by the clutch assembly (5). The output shaft (4) is connected to a diesel engine/transmission. The output shaft (4) extends through transmission case (15) and extends through clutch slide assembly (12). A seal (18) is used at the juncture. The clutch slide assembly (12) has a slide plate (13), a forward plate (19), a forward bearing, a rear rim (20), and a hollow cylindrical housing section (21) with splines (22) for receiving grooves (23) of output shaft (4). The rear rim has a forward face (24) having a plurality of sockets (25) and a rear face (26) having a plurality of dogs (27). The slide plate (13) is slidably and rotatably positioned on the output shaft for rotary and linear movement. The output shaft extends into the clutch assembly and terminates with end (14*c*) extending into end (6*a*) of inner propeller shaft (6) in a pilot assembly. The grooves (23) mesh with splines (22) formed on inner wall (28) of the cylindrical housing section to rotate the slide plate with the output shaft.

Connected to the forward plate (19) of the clutch slide assembly is a yoke control assembly (30) having a yoke means (31) for moving the slide plate. The yoke means (31) is operated by the marine vessel operator through a control device normally positioned near the helm of the vessel. The yoke control assembly utilizes a clutch actuation cable (32) which runs through a dead man (33). A second dead man (34) is also provided for the yoke control assembly (30). The yoke control assembly (30) also has a yoke arm (35) connected to the cable (32). The arm (35) engages the forward plate (19) of the slide plate (13). Accordingly, the operator may actuate the cable (32) to slide the slide plate (13) along the output shaft (4).

An opening (36) is provided in forward plate (19) for receiving the output shaft (4) and the cylindrical housing section (21) of the slide plate (13). Integrally formed on rear face (26) of the forward plate (19) are dogs (38). The forward plate (19) is bolted to side section (39) of the clutch housing (10).

Surrounding clutch assembly (5) is a brake band (40). The brake band is operated by brake control cable (41). The brake band (40) is connected to a third dead man (52) by a cotter or roll pin (53). The brake band assembly as described is well known in the art. The braking apparatus is used to slow or stop the inner propeller (8) to create drag on the vessel, to aid in stopping, maneuvering, and operating at slow speeds. In addition, when the drive is disengaged from the power source, and the clutch has both propellers locked together, the brake will stop both propellers from turning. In applications where two drive systems are mounted side by side in the same hull, stopping one side allows the vessel to pivot as it turns to that side. This is very advantageous in close quarter maneuvering. The brake also allows the inner propeller to stop while the outer propeller turns. This can be helpful in clearing seaweed from the propellers if they become clogged, and can help lighter boats move even slower for trolling and maneuvering in close quarters.

The rear area of the clutch assembly includes an opening (55) for receiving the inner shaft (6) and outer shaft (7). The opening is formed by a cylindrical neck (56) formed in rear wall of the clutch assembly. The neck (56) forms a ledge (57) on rear face (58) of rear wall (59) of the clutch assembly. Sockets (60) are located on front face (61) of the inner wall and they mate with dogs (27) during clutch operation. On rear face (58) of rear wall (59) are threaded apertures for receiving bolts (63). The bolts secure a shock absorber (65) to the ledge (57). The outer propeller shaft is also secured to the shock absorber by bolts (66). The outer propeller shaft, the inner propeller shaft, and the shock absorber are connected to the clutch assembly through the above described connections and are assisted by a clearance fit well known in the art.

The inner propeller shaft (6) extends coaxially of the outer propeller shaft (7) and terminates with the outer propeller (9). The inner shaft extends through both propellers and is connected to the outer propeller by splines (80). A lock nut assembly (81) secures the propeller assemblies on the shafts. The inner propeller shaft and the outer propeller shaft are separated by a typical bearing assembly (82) well known in the art. Surrounding the outer propeller shaft at (83) and (84) are additional bearing assemblies.

As shown in FIG. 2 outer propeller (9) is connected to the inner propeller shaft (6) by splines (80). Positioned inside outer propeller (9) is inner propeller (8) which is connected by a key assembly (85) and is secured to outer propeller shaft (7) by a lock nut assembly well known in the art. The inner propeller is spaced from the outer propeller with a gap of less than 1 inch between the two propeller assemblies. The propellers have outer blades (86) and inner blades (87) which may be of any size relative to each other. The blades for each propeller assembly are integrally formed on their respective hubs.

Figure 3:
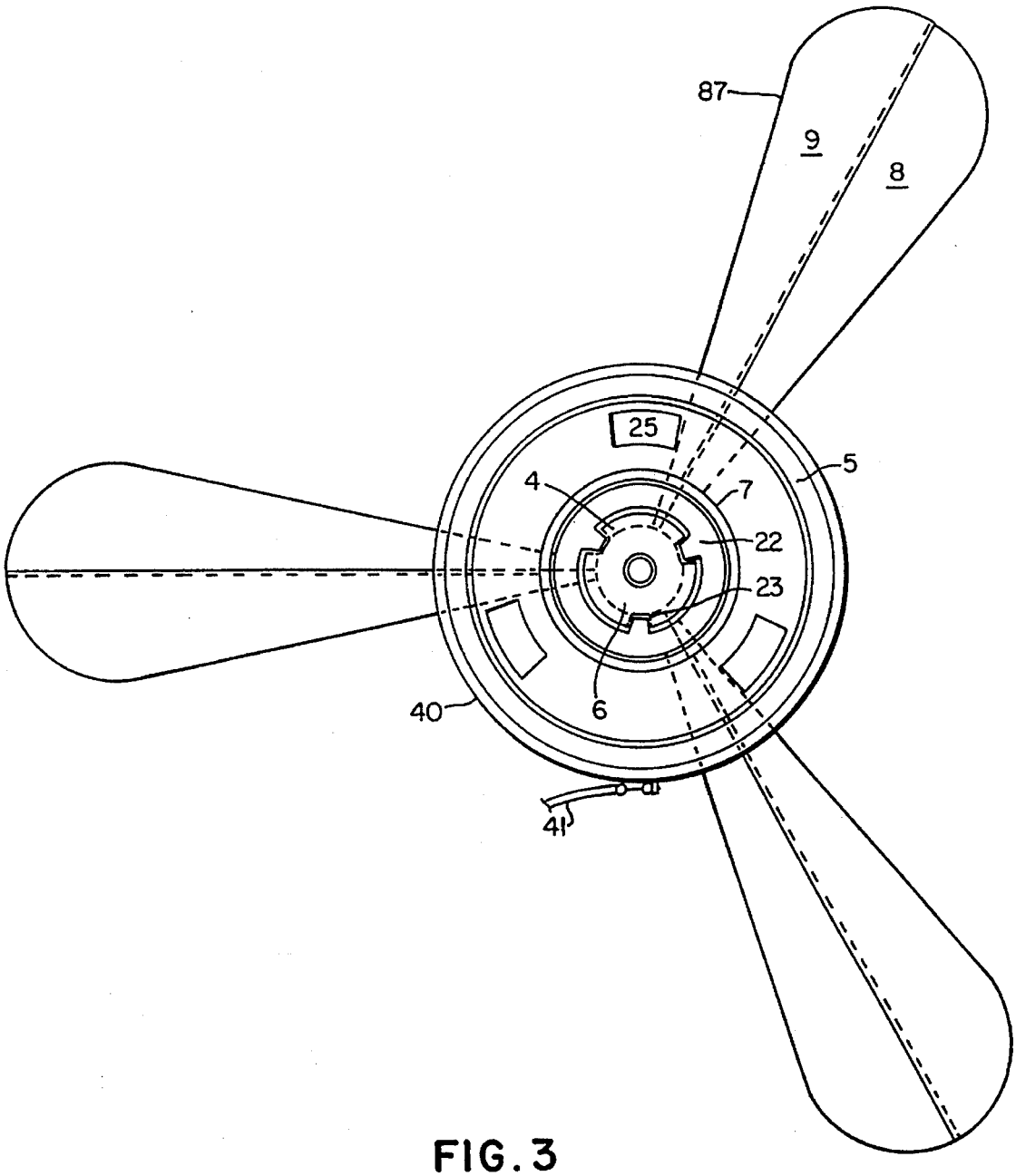
FIG. 3 is a cross sectional view along lines 1—1 of the propeller drive.

Turning to FIG. 3 a cross sectional view taken along lines 1—1 of the propeller drive is illustrated. Splines (22) and grooves (23) are shown in mating engagement. As previously described, the splines (22), grooves (23), and clutch slide plate (13) form the central arrangement of the clutch assembly. Outer blades (86) and inner blades (87) are only in a fixed alignment when the propellers are locked together.

The clutch assembly is functionally operable with the propeller blades by using the same number of engaging mechanisms as blades on each propeller. The alignment of the dogs, sockets, and locking grooves provide a direct connection from the output shaft to both propellers. Operation of the propeller drive will now be described.

With the engine running, the operator of the boat may engage either propeller or both using the control device. By shifting the slide plate into one of four positions the propeller drive may be used for neutral or one of three propeller operations. Movement of the slide plate toward the front of the clutch housing permits dogs (38) to mate with sockets (25) and drive outer propeller shaft (7) and inner propeller (8). As desired, the operator may move the slide plate off dogs (38) to a neutral position as illustrated in FIG. 2. Further movement of the slide plate positions splines (22) into locking grooves (23). When the splines engage the locking grooves the output shaft will spin the slide plate and turn the inner propeller shaft to rotate the outer propeller. Full movement of the slide plate to the rear of the clutch assembly locks the dogs (27) with sockets (60) for operation of both propellers in unison.

Figure 4:
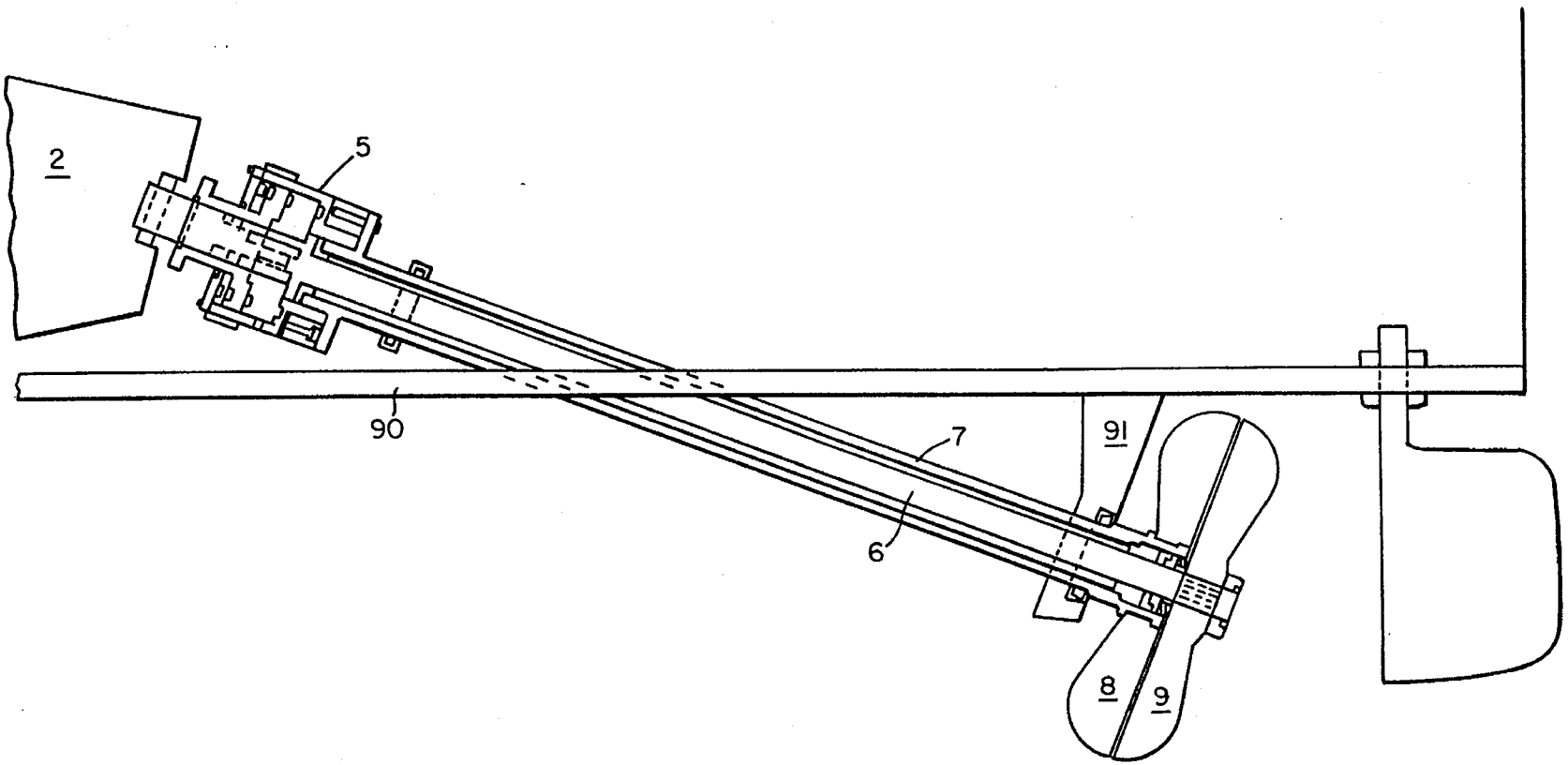
FIG. 4 is a sectional view showing an embodiment in which the propeller drive is employed with an inboard/outboard motor.

With reference to FIG. 4, the propeller drive system of the present invention is illustrated for use with an inboard/outboard motor. The propeller drive extends through the hull (90) and is supported by a hanger (91) mounted on the underside of the hull.

This invention provides the means to change the thrust developed by a propeller system without changing the ratio of engine speed to propeller speed. The range of thrust developed by this invention is not limited by the range of engine speed driving it. In addition, there are no gearboxes, differentials, or complicated adjustable pitch propellers to contend with. It should be noted that when this drive is working hardest, developing its maximum thrust, the whole system is locked together. And, if for some reason the propellers should be bent into each other by hitting an obstruction, or the propshafts should seize together, the vessel can make it back to port in high range.

Each propeller is selected for optimum performance in the part of the vessel speed range for which it will be creating the thrust. The two propellers are made in such a way that when the clutch mechanism locks them together, they work as if they were one propeller. The propellers are arranged so that they are aligned to work together when the clutch is locked up. The pitch, radius, blade size, and style of the propellers shall be selected to meet the requirements of the proposed operation of the vessel. Vessel speeds will be limited only by horsepower and torque of the engine, and not by the engine speed range.

Smaller craft may be driven by a two speed version of this drive. This is the same drive without the capability to run the inner propeller independently. The outer propeller provides slow speed thrust with the propellers combined to provide high speed thrust. By eliminating one thrust range, the manufacturer will be able to reduce weight, cost, and complexity of the drive for certain applications where these qualities are desirable.

Ultimately, this drive system equals and surpasses the performance of drives that change thrust by changing engine speed alone. As a general rule, the slower you turn propellers, the more efficiently they transmit force to water and create thrust. Propellers have a relatively small rotational speed range in which they are very efficient. This drive allows the propellers to work within this rotational speed range to create the desired thrust range.

With reference to the particulars of the propellers, as the propellers turn the angled faces cut into the water, and in the process, pressure is created on the rear side of the blade while a vacuum is formed on the front edge. These two forces together impart motion to the vessel. When propellers (8, 9) are locked together, water spills from each blade on inner propeller (8) to a corresponding blade on outer propeller (9) to drive the vessel at top end speed. The thrust of the propellers when working as a unit should be considered for each particular vessel in order to achieve the speed desired.

Where slow speeds are desired, the propulsion drive system permits operation of the outer propeller only through the selective use of the control device. Moreover, when using a diesel engine with the present invention a large propeller unit may be selected because the propulsion system offers single use of a portion of the propeller for operating at slow speeds.

The invention further provides a propeller drive system for diesel engines used on marine vessels. By selecting the correct size propeller to drive the chosen boat at the desired top end speed and dividing the propeller into two parts, the outer part being sufficient in size to drive the vessel efficiently at slow speeds and arrange them on this drive system as two separate propellers that lock together to create one large propeller, the diesel engine is enabled to meet and even to surpass the performance of the gasoline engine. Accordingly, this propeller drive enables a vessel to be operated at maximum hull speed by an engine of sufficient power, without regard to engine speed range and also to be operated at slow hull speeds by the same engine, by the selection of proper pitch and diameter to match horsepower and engine speed range with hull speed of the vessel. Accordingly, this propeller drive enables a vessel to be operated at maximum hull speed and minimum hull speed within the range of the engine's speed range.

What is claimed is:

1. A propeller drive for a marine vessel, comprising:

a diesel engine, said diesel engine having a transmission and an output shaft;

a clutch assembly, said clutch assembly connected to said output shaft of said diesel engine;

an outer propeller shaft and an inner propeller shaft connected to said clutch assembly and extending coaxially away from said clutch assembly;

an inner propeller, said inner propeller connected to said outer propeller shaft, said inner propeller rotatably operated through said clutch assembly by said output shaft;

an outer propeller, said outer propeller connected to said inner propeller shaft, said inner propeller rotatably operated through said clutch assembly by said output shaft, said inner propeller and said outer propeller both selectably operable for rotation in the same direction so that said inner propeller may be driven without driving said outer propeller or so that said outer propeller may be driven without driving said inner propeller.

2. A propeller drive as defined in claim 1 wherein said outer propeller and said inner propeller are engaged for unison operation.

3. A propeller drive as defined in claim 1 wherein said diesel engine is mounted inside said marine vessel.

4. A propeller drive as defined in claim 1 wherein said diesel engine is mounted as an inboard/outboard arrangement.

5. A propeller drive as defined in claim 1 wherein said clutch assembly is operated by a yoke assembly which is connected to said clutch assembly.

6. A propeller drive as defined in claim 1 wherein said inner propeller shaft and said outer propeller are selectively engaged for rotation by said clutch assembly and said output shaft of said diesel engine.

7. A propeller drive as defined in claim 1 wherein said inner propeller is larger than said outer propeller.

8. A propeller drive assembly for a marine vessel, comprising:

a clutch assembly, said clutch assembly connected to an engine having a transmission and an output shaft, and connected to a pair of coaxially mounted propeller shafts, said pair of coaxially mounted propeller shafts including an inner shaft and an outer shaft;

a propeller arrangement, said propeller arrangement including an inner propeller and an outer propeller, said inner propeller connected to said outer propeller shaft and said outer propeller connected to said inner propeller shaft;

and control means for selectively and independently engaging said inner propeller or said outer propeller or both propellers for operable driving rotation in the same direction so that said inner propeller may be driven without driving said outer propeller or so that said outer propeller may be driven without driving said inner propeller.

9. A propeller drive as defined in claim 8 wherein said outer propeller and said inner propeller are engaged for unison operation.

10. A propeller drive as defined in claim 8 wherein said diesel engine is mounted inside said marine vessel.

11. A propeller drive as defined in claim 8 wherein said diesel engine is mounted as an inboard/outboard arrangement.

12. A propeller drive as defined in claim 8 wherein said clutch assembly is operated by a yoke assembly which is connected to said clutch assembly.

13. A propeller drive as defined in claim 8 wherein said inner propeller shaft and said outer propeller are selectively engaged for rotation by said clutch assembly and said output shaft of said diesel engine.

14. A propeller drive as defined in claim 8 wherein said inner propeller is larger than said outer propeller.

15. A propeller drive assembly for a marine vessel, comprising:

an outer propeller, said outer propeller connected to an inner propeller shaft;

an inner propeller, said inner propeller connected to an outer propeller shaft;

a clutch assembly, said clutch assembly connected to said outer propeller shaft and said inner propeller shaft, said clutch assembly operable for engaging said inner propeller shaft or said outer propeller shaft or both shafts for simultaneous and independent operation in the same direction of rotation so that said inner propeller may be driven without driving said outer propeller or so that said outer propeller may be driven without driving said inner propeller.

16. A propeller drive as defined in claim 15 wherein said outer propeller and said inner propeller are engaged for unison operation.

17. A propeller drive as defined in claim 15 wherein said diesel engine is mounted inside said marine vessel.

18. A propeller drive as defined in claim 15 wherein said diesel engine is mounted as an inboard/outboard arrangement.

19. A propeller drive as defined in claim 15 wherein said clutch assembly is operated by a yoke assembly which is connected to said clutch assembly.

20. A propeller drive as defined in claim 15 wherein said inner propeller shaft and said outer propeller are selectively engaged for rotation by said clutch assembly and said output shaft of said diesel engine.

21. A propeller drive as defined in claim 15 wherein said inner propeller and said outer propeller include blades, each blade of substantially the same size.

22. A propeller drive as defined in claim 15 wherein said inner propeller is larger than said outer propeller.

* * * * *